US011008696B2

(12) United States Patent
Schurr

(10) Patent No.: US 11,008,696 B2
(45) Date of Patent: May 18, 2021

(54) SUPPLEMENTAL CONDENSATE DELIVERY SYSTEM HAVING A SNAP-IN DRAIN MEMBER

(71) Applicant: WHIRLPOOL CORPORATION, Benton Harbor, MI (US)

(72) Inventor: Daniel A. Schurr, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 279 days.

(21) Appl. No.: 16/235,678

(22) Filed: Dec. 28, 2018

(65) Prior Publication Data

US 2020/0208338 A1 Jul. 2, 2020

(51) Int. Cl.

| | |
|---|---|
| ***D06F 58/24*** | (2006.01) |
| ***D06F 58/04*** | (2006.01) |
| ***D06F 58/26*** | (2006.01) |

(52) U.S. Cl.

CPC ..... *D06F 58/24* (2013.01); *D06F 58/04* (2013.01); *D06F 58/26* (2013.01)

(58) Field of Classification Search

CPC ..... D06F 58/04; D06F 58/24; D06F 58/26
USPC ..... 34/595–610
See application file for complete search history.

(56) References Cited

U.S. PATENT DOCUMENTS

| | | | | |
|---|---|---|---|---|
| 5,226,203 | A * | 7/1993 | Sacconato | D06F 58/24 34/282 |
| 7,596,884 | B2 | 10/2009 | Kim | |
| 7,950,419 | B2 | 5/2011 | Kaden et al. | |
| 8,438,750 | B2 * | 5/2013 | Dittmer | D06F 58/22 34/83 |
| 8,615,895 | B2 * | 12/2013 | Shin | D06F 58/22 34/82 |
| 8,844,163 | B2 | 9/2014 | Palazzin et al. | |
| 9,273,903 | B2 | 3/2016 | Vian et al. | |
| 9,834,882 | B2 * | 12/2017 | Patil | F26B 21/086 |
| 10,077,528 | B2 * | 9/2018 | Yoichi | D06F 58/22 |
| 10,094,065 | B2 | 10/2018 | Kim et al. | |
| 10,280,553 | B2 * | 5/2019 | Shin | D06F 58/02 |
| 10,544,539 | B2 * | 1/2020 | Bocchino | D06F 58/22 |
| 10,590,593 | B1 * | 3/2020 | Leibman | D06F 58/22 |
| 10,633,785 | B2 * | 4/2020 | Bocchino | D06F 58/02 |
| 10,765,974 | B2 * | 9/2020 | Renz | B01D 29/09 |
| 2012/0017456 | A1 * | 1/2012 | Grunert | D06F 58/24 34/82 |
| 2016/0160425 | A1 | 6/2016 | Bison et al. | |

(Continued)

FOREIGN PATENT DOCUMENTS

| | | |
|---|---|---|
| EP | 3071744 | 9/2016 |
| EP | 3090094 | 11/2016 |

(Continued)

*Primary Examiner* — Stephen M Gravini
(74) *Attorney, Agent, or Firm* — Price Heneveld LLP

(57) ABSTRACT

A laundry appliance includes a blower for delivering process air through an airflow path that includes a rotating drum. A condensation system has a heat exchanger that dehumidifies process air within a condensing portion of the airflow path to produce a condensate. A residual condensing area of the airflow path is positioned upstream of the heat exchanger. The residual condensing area produces secondary condensate. A primary flow path delivers the condensate from the condensing portion to a sump. A secondary flow path delivers the secondary condensate from the residual condensing area to the sump.

15 Claims, 13 Drawing Sheets

(56) References Cited

U.S. PATENT DOCUMENTS

| | | | | |
|---|---|---|---|---|
| 2017/0051449 | A1 | 2/2017 | Nam et al. | |
| 2020/0208338 | A1 * | 7/2020 | Schurr | D06F 58/20 |

FOREIGN PATENT DOCUMENTS

| | | | | |
|---|---|---|---|---|
| EP | 3366829 | | 8/2018 | |
| EP | 3674475 | A1 * | 7/2020 | D06F 58/04 |
| WO | 2016045173 | | 3/2016 | |
| WO | WO-2016045173 | A1 * | 3/2016 | D06F 58/22 |
| WO | 2018162081 | | 9/2018 | |

* cited by examiner

SUPPLEMENTAL CONDENSATE DELIVERY SYSTEM HAVING A SNAP-IN DRAIN MEMBER

FIELD OF THE DEVICE

The device is in the field of laundry appliances, and more specifically, a fluid delivery system for transferring residually formed condensate to a sump area via a dedicated secondary condensate path.

SUMMARY

In at least one aspect, a laundry appliance includes a blower for delivering process air through an airflow path that includes a rotating drum. A condensation system has a heat exchanger that dehumidifies process air within a condensing portion of the airflow path to produce a condensate. A residual condensing area of the airflow path is positioned upstream of the heat exchanger. The residual condensing area produces secondary condensate. A primary flow path delivers the condensate from the condensing portion to a sump. A secondary flow path delivers the secondary condensate from the residual condensing area to the sump.

In at least another aspect, a laundry appliance includes a blower for delivering process air through an airflow path that includes a rotating drum. A condensation system has a dehumidifier for separating condensate from the process air at a condensing portion of the airflow path. A primary flow path delivers the condensate from the condensing portion to a sump. A residual condensing area of the airflow path is positioned between the rotating drum and a heat exchanger. The residual condensing area produces secondary condensate that is separately delivered to the sump. A drain member extends from the residual condensing area to the sump for delivering the secondary condensate to the sump. The drain member includes an inlet end that engages a basement of the appliance proximate the residual condensing area and an outlet end that engages the basement at a fluid delivery channel in communication with the sump.

In at least another aspect, a fluid delivery system for a laundry appliance includes a condensation system disposed within a basement structure and having a dehumidifier for separating condensate from process air. A primary flow path delivers the condensate from the condensation system to a sump. A residual condensing area is positioned distal from the condensation system. The residual condensing area produces secondary condensate that is separately delivered to the sump. A drain member extends from the residual condensing area to a fluid delivery channel for delivering the secondary condensate to the sump. The drain member includes an inlet end that is biased against a wall of the basement structure proximate the residual condensing area and an outlet end that is biased against the fluid delivery channel.

These and other features, advantages, and objects of the present device will be further understood and appreciated by those skilled in the art upon studying the following specification, claims, and appended drawings.

DETAILED DESCRIPTION OF EMBODIMENTS

Figure 1:
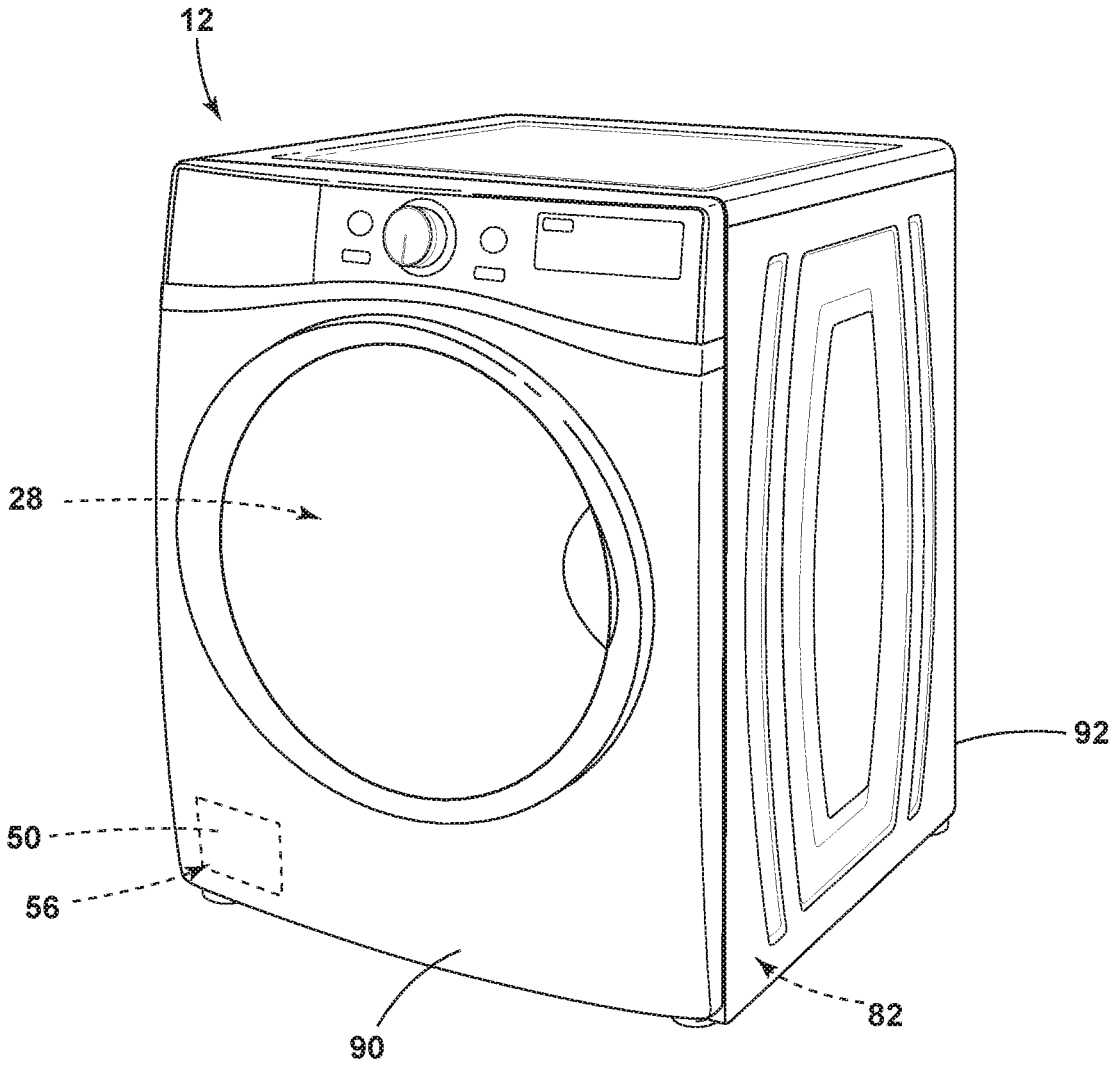
FIG. 1 is a front elevational view of a drying appliance that incorporates an aspect of the fluid delivery system having the secondary flow path.
Figure 2:
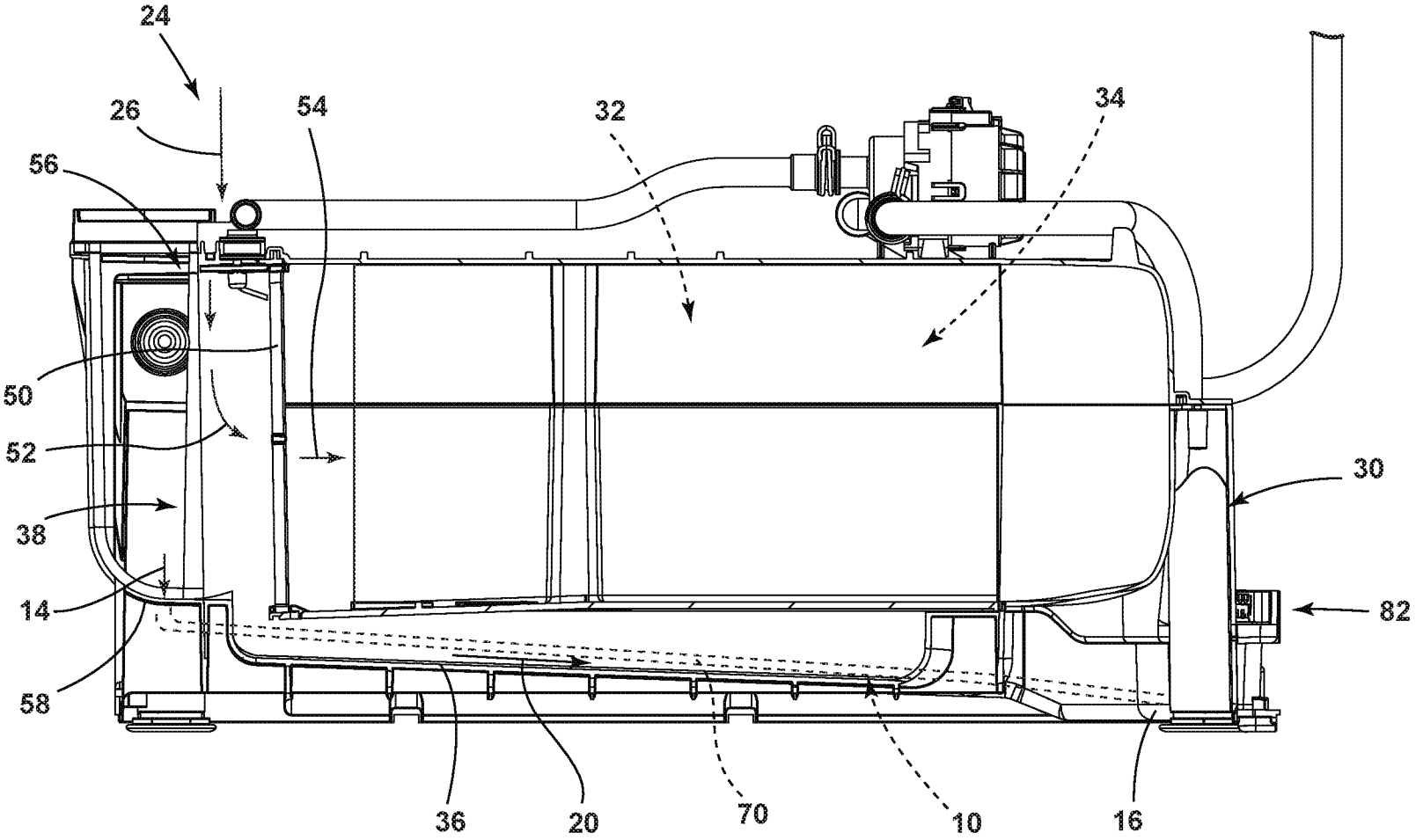
FIG. 2 is a cross-sectional view of a basement for the appliance of FIG. 1 and showing a location of the secondary flow path in relation to the sump.
Figure 3:
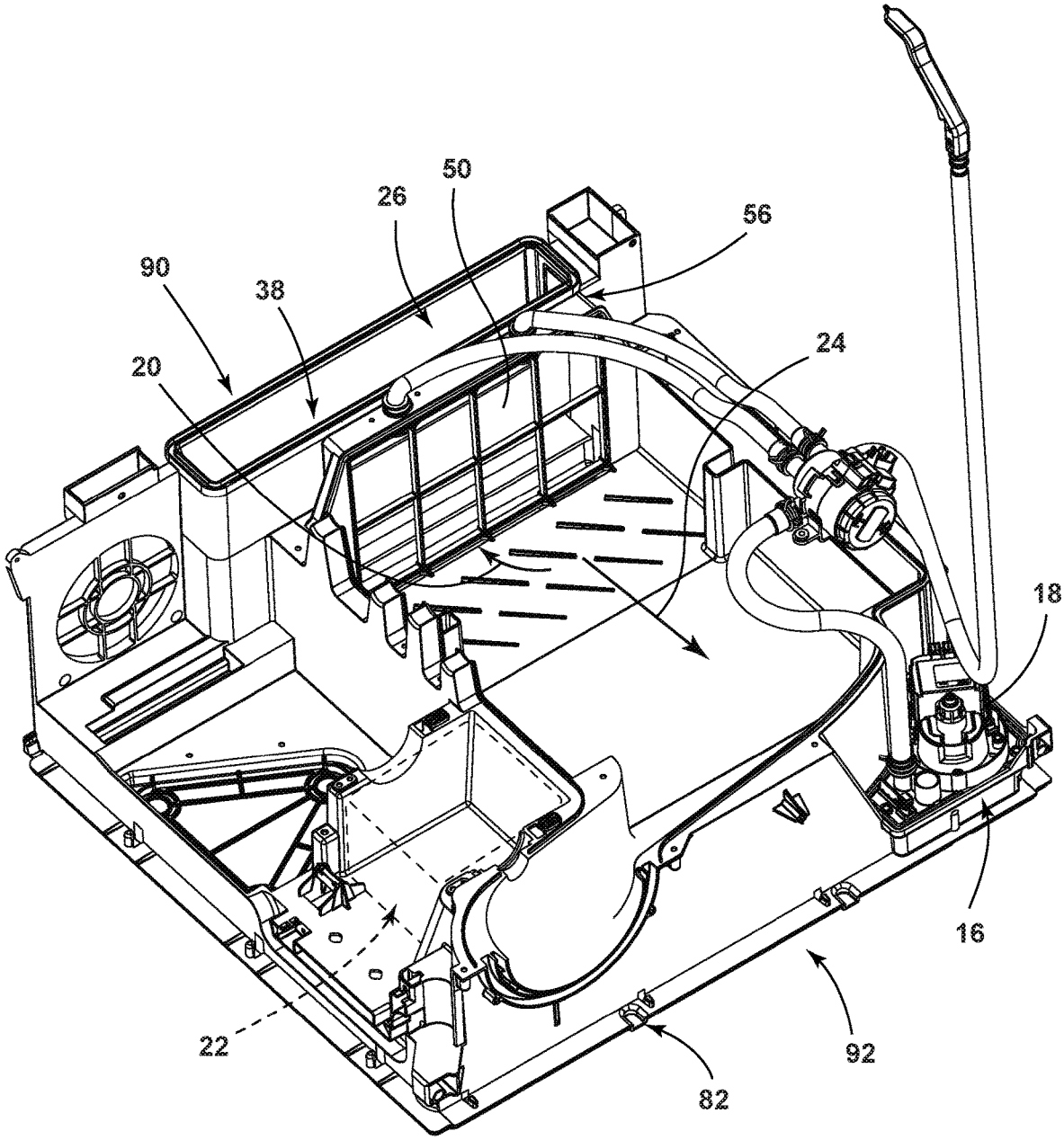
FIG. 3 is a top perspective view of an aspect of a basement for a laundry appliance and showing a location of the sump in relation to the residual condensing area for the appliance.
Figure 4:
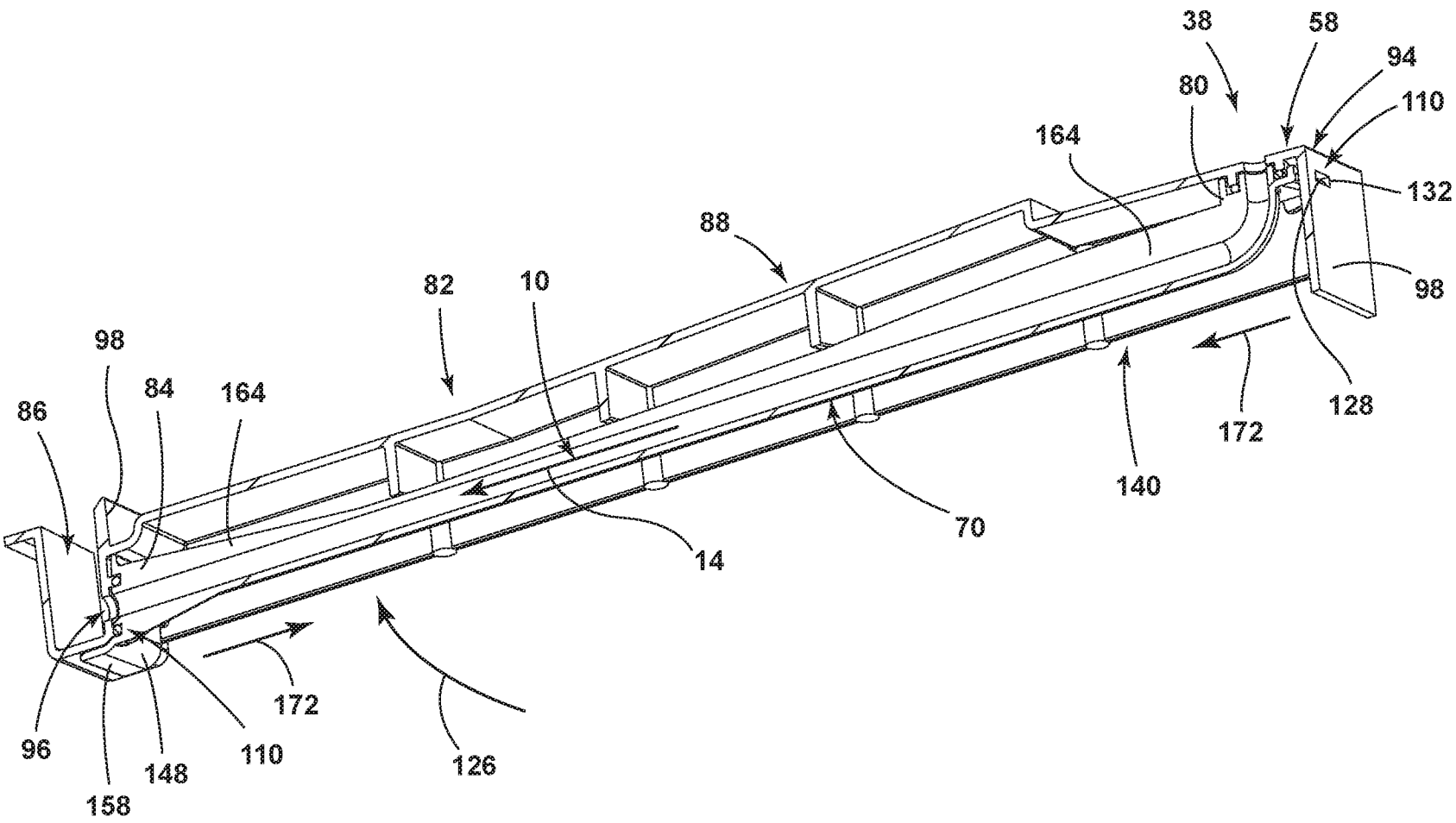
FIG. 4 is a cross-sectional perspective view of an aspect of the secondary flow path showing engagement of the drain member with the basement for the appliance.
Figure 5:
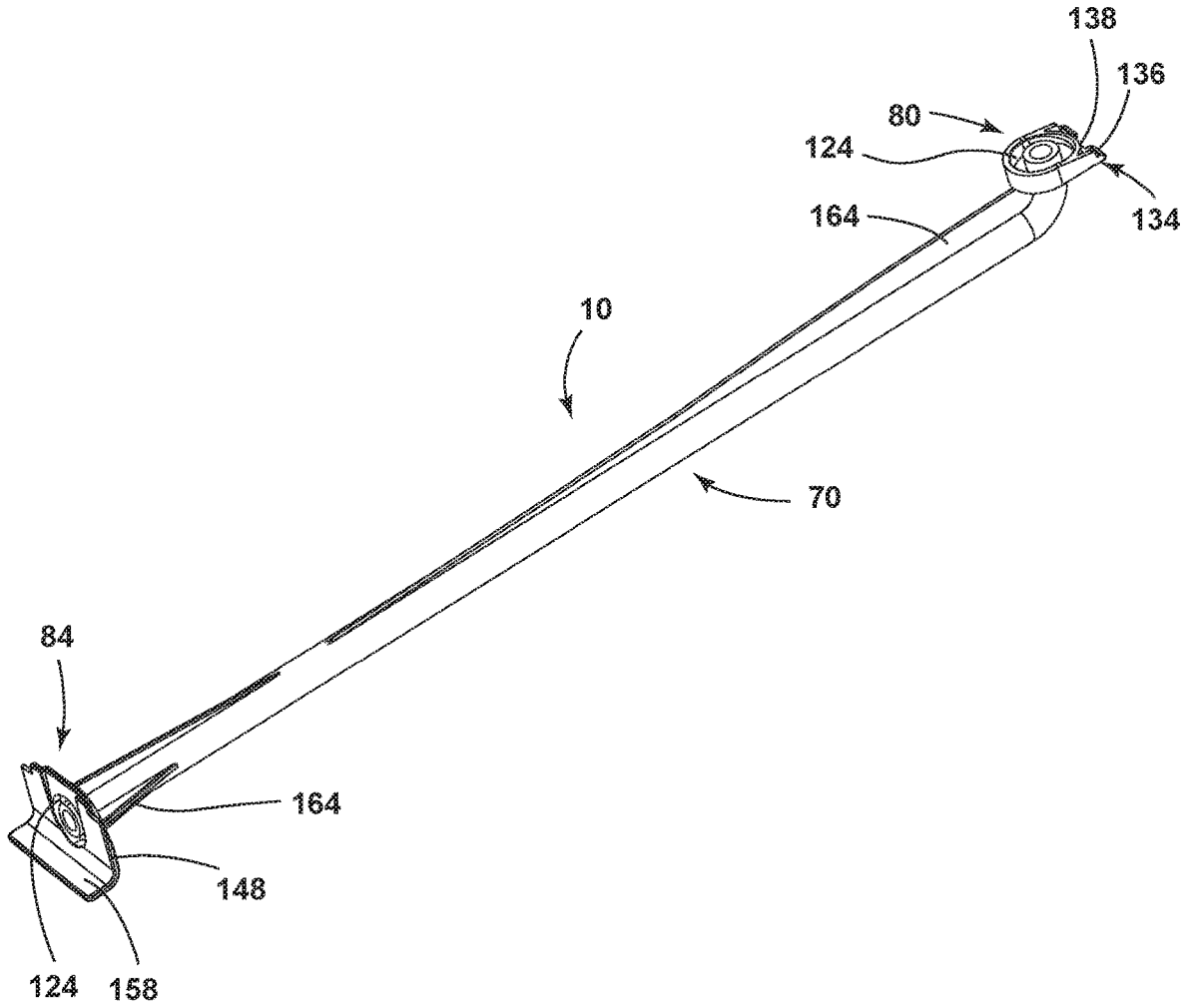
FIG. 5 is a perspective view of an aspect of the drain member that defines the secondary flow path for the appliance.
Figure 7:
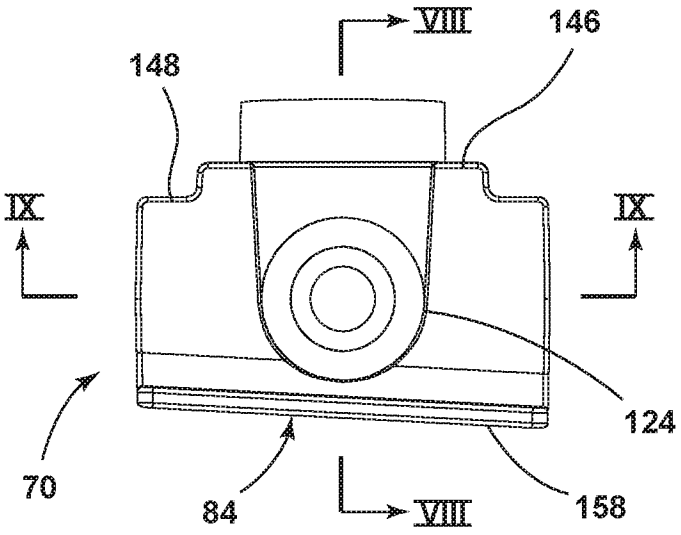
FIG. 7 is an end elevational view of the outlet end for the drain member of FIG. 5.
Figure 6:
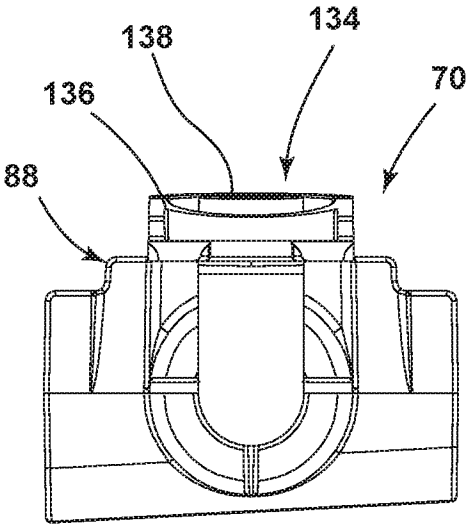
FIG. 6 is an elevational view of the inlet end for the drain member of FIG. 5.
Figure 8:
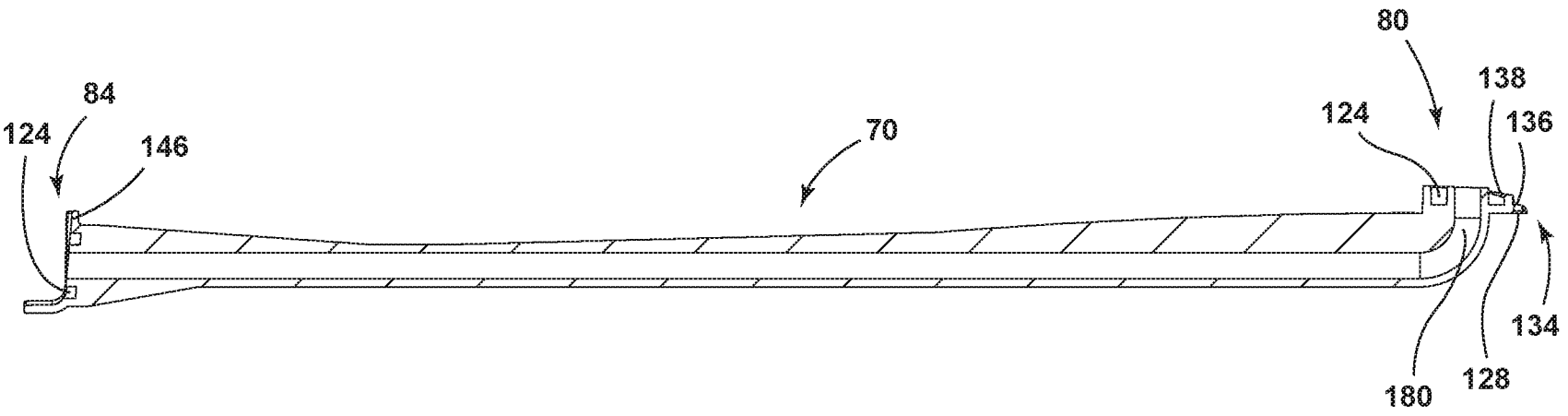
FIG. 8 is a first cross-sectional view of the drain member of FIG. 7 taken along line VIII-VIII.
Figure 9:
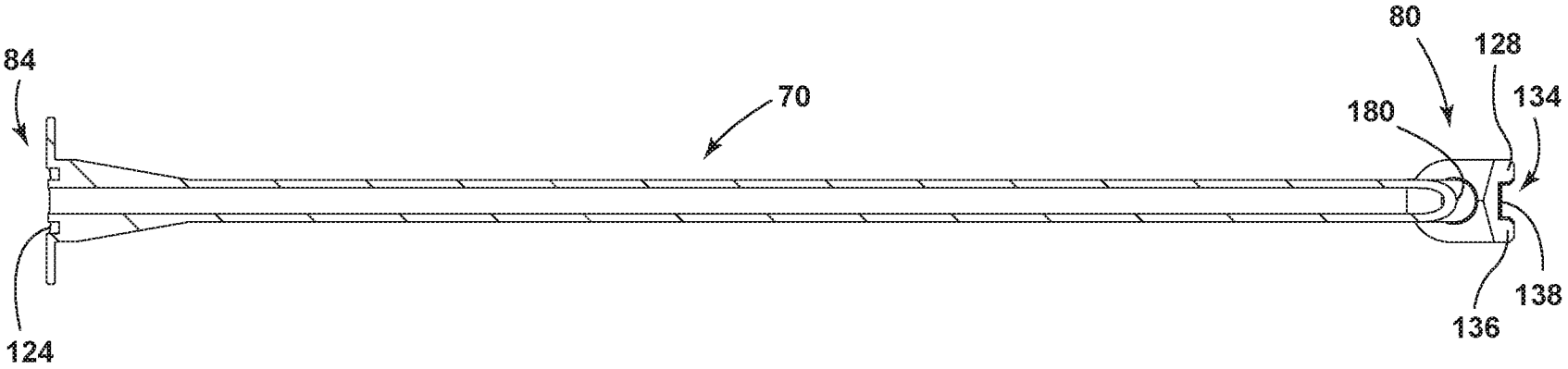
FIG. 9 is a cross-sectional view of the drain member of FIG. 7 taken along line IX-IX.
Figure 11:
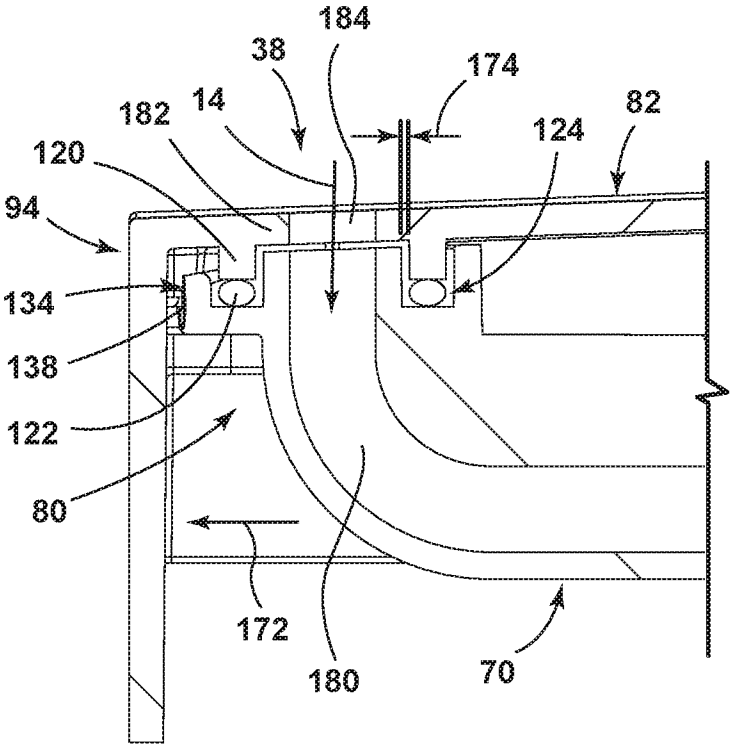
FIG. 11 is an enlarged cross-sectional view of the inlet end for the drain member engaging the inlet receptacle for the appliance.
Figure 10:
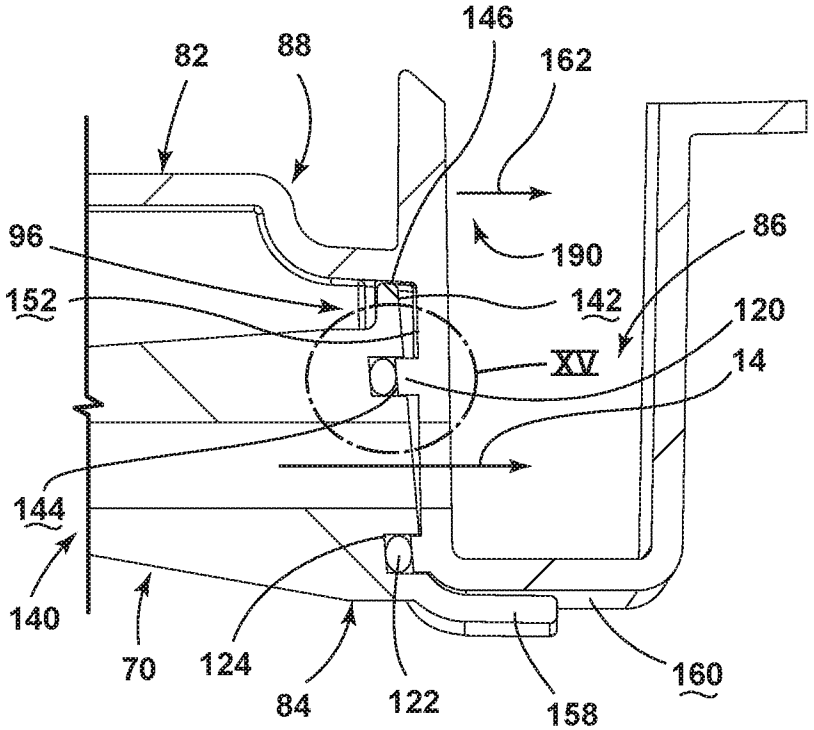
FIG. 10 is an enlarged cross-sectional view of the outlet end for the drain member and engaging the outlet receptacle.
Figure 12:
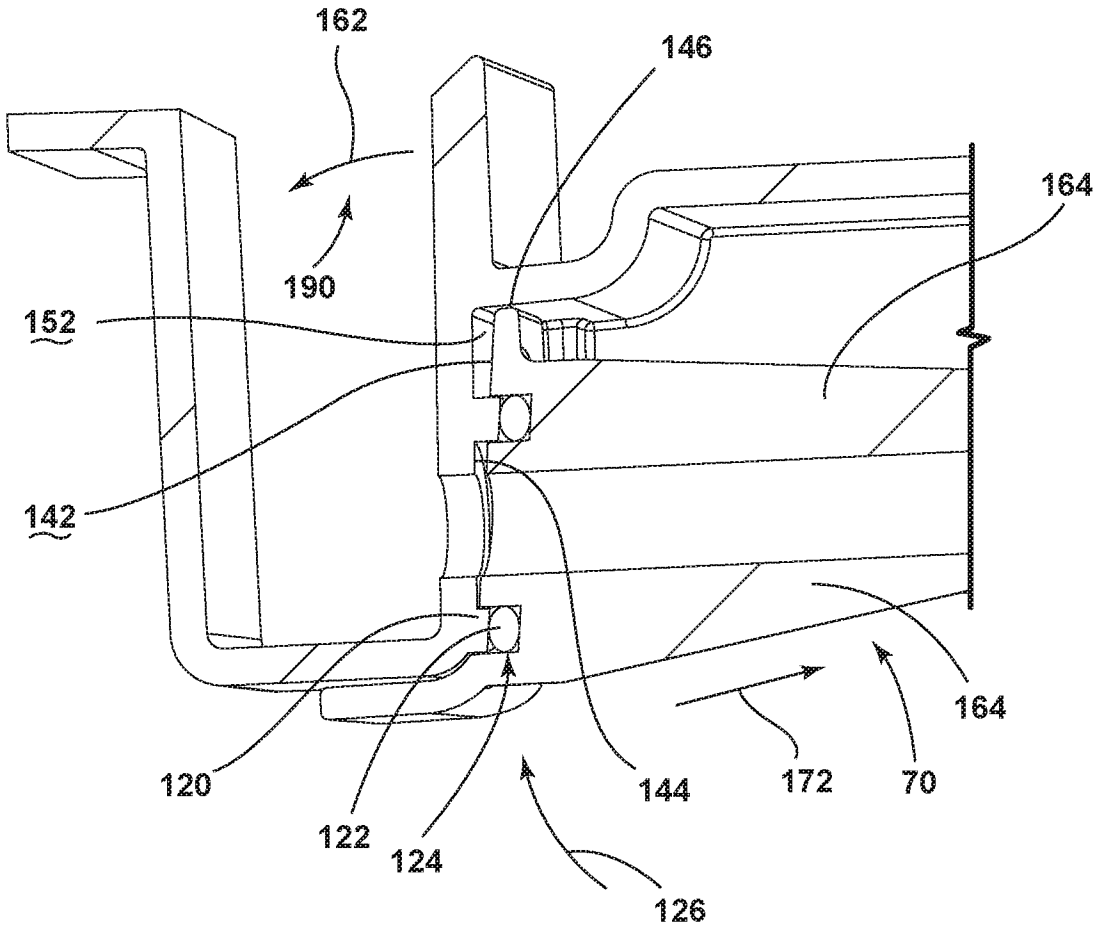
FIG. 12 is a cross-sectional view of the outlet end and showing deflection of the basement during installation of the drain member within the basement.
Figure 14:
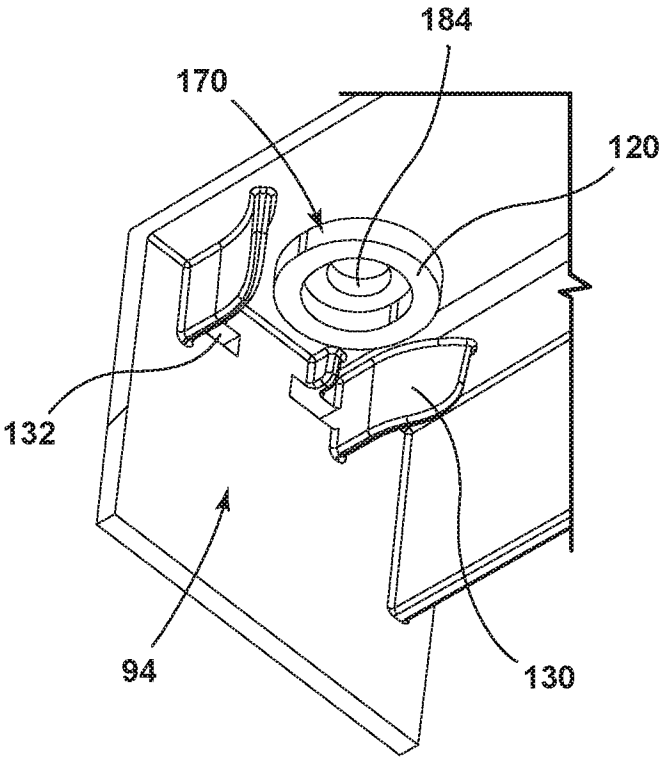
FIG. 14 is an enlarged perspective view of the inlet receptacle for the basement.
Figure 13:
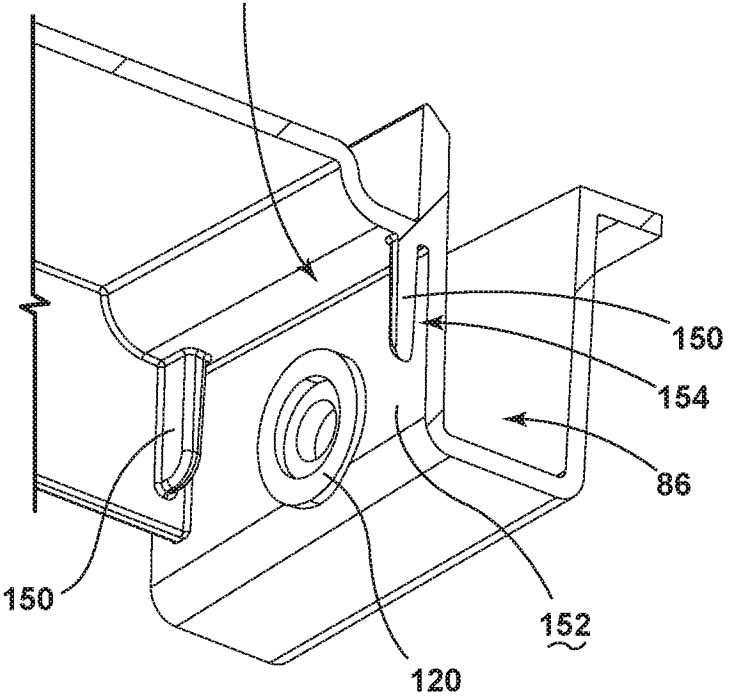
FIG. 13 is an enlarged perspective view of the outlet receptacle for the basement.
Figure 15:
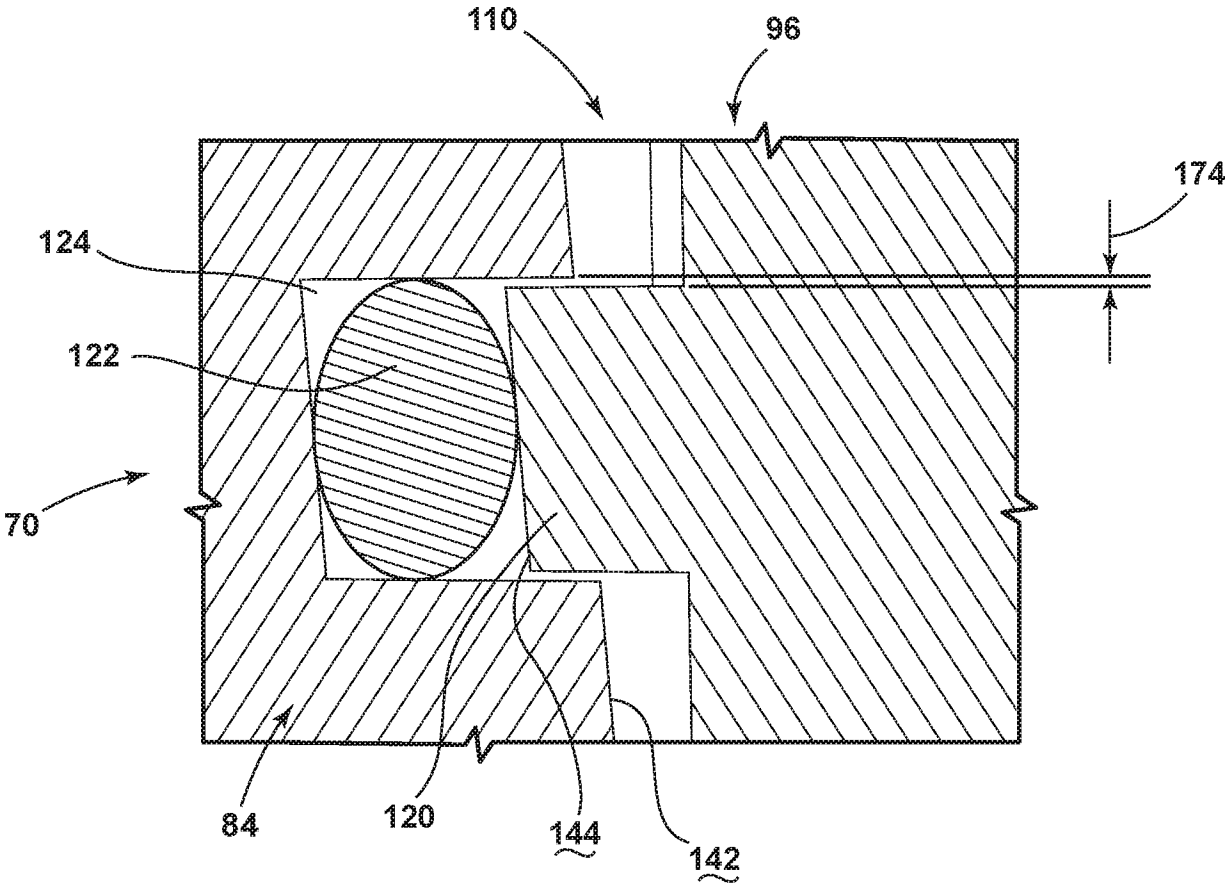
FIG. 15 is an enlarged cross-sectional view of a sealing engagement at the outlet end of the drain member of FIG. 10, taken at area XVI.
Figure 17:
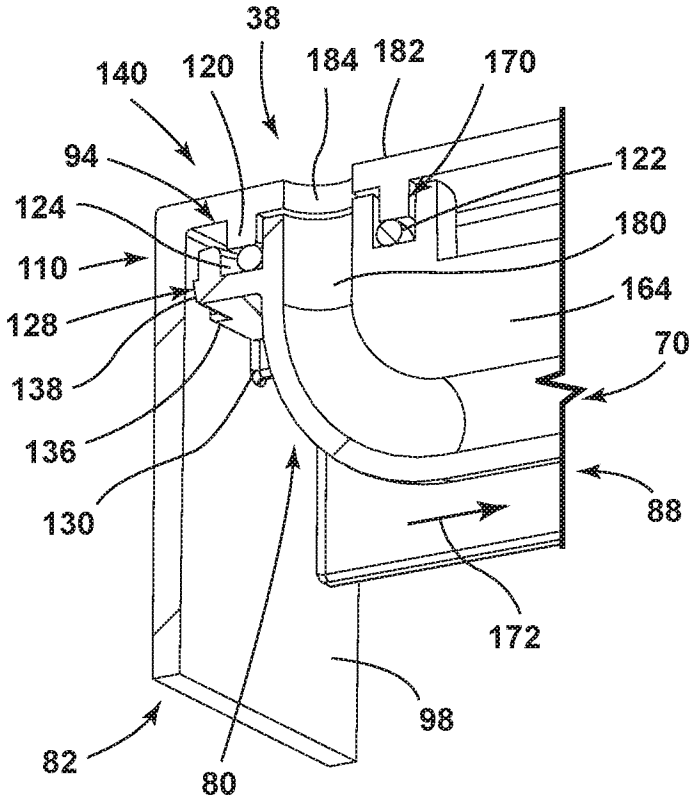
FIG. 17 is an enlarged perspective view of the inlet receptacle and showing the elongated configuration of the annular structure at the inlet end.
Figure 16:
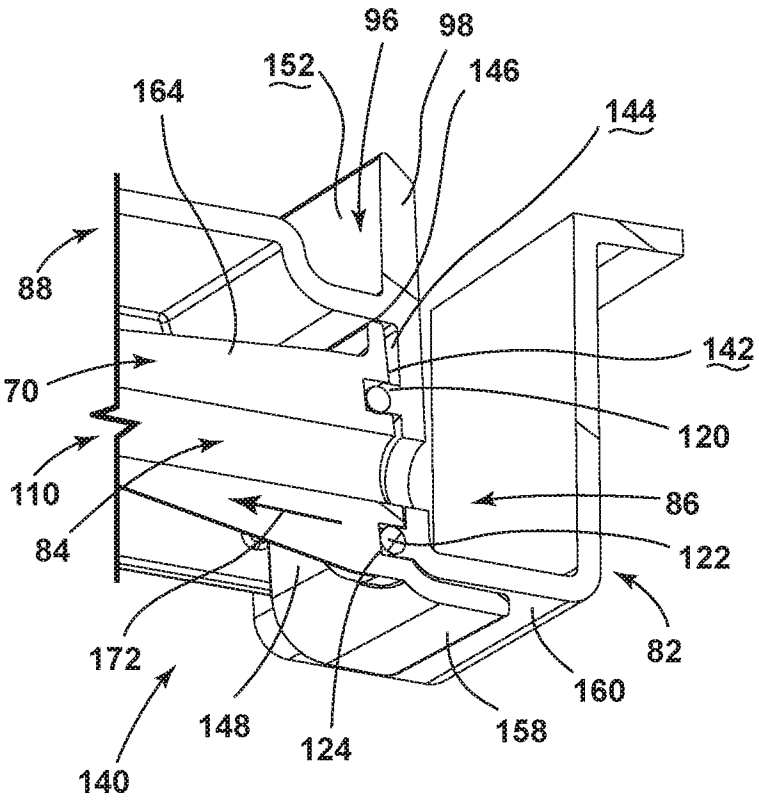
FIG. 16 is an enlarged perspective view of the annular structure at the outlet end.
Figure 18:
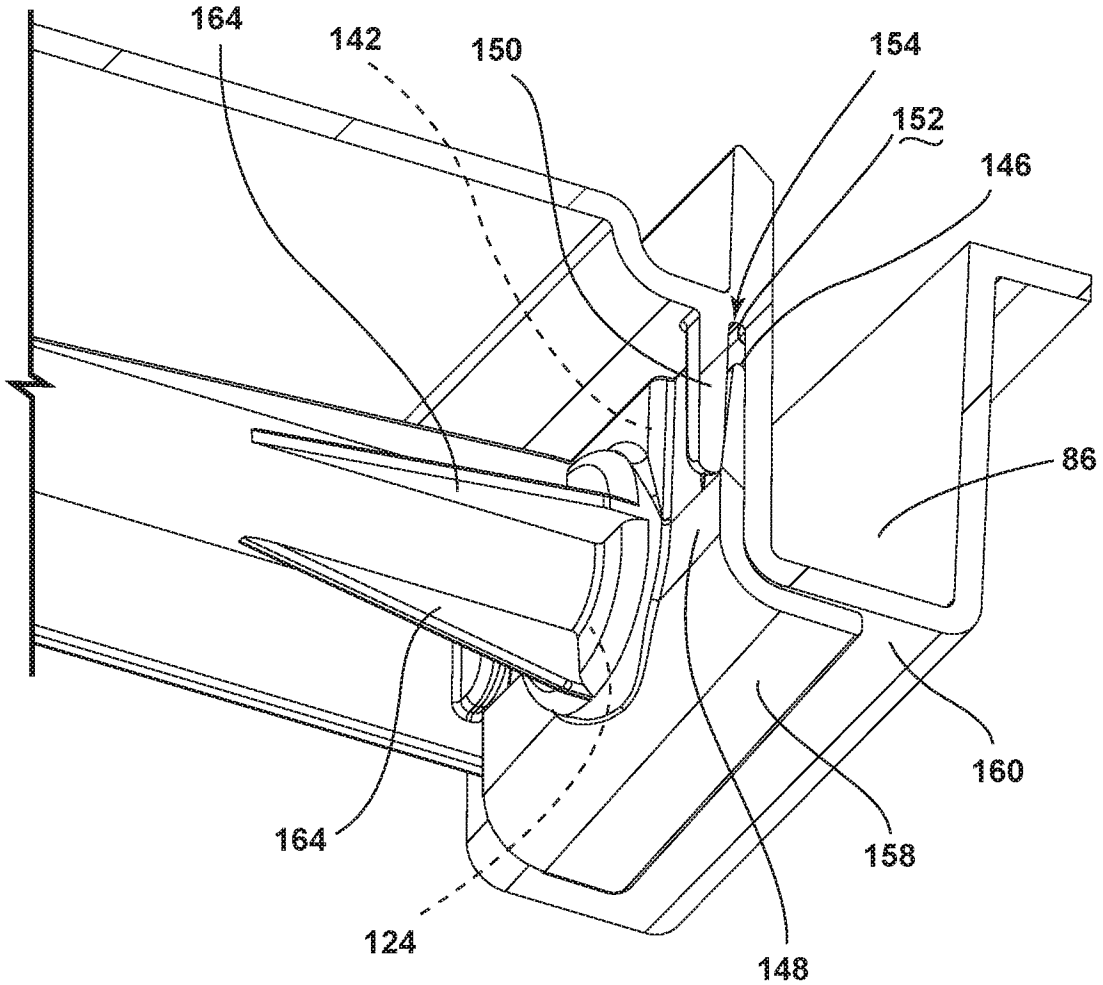
FIG. 18 is a cross-sectional perspective view of the outlet end of the drain member and showing engagement with the outlet receptacle for the basement.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-18, reference numeral 10 generally refers to a secondary flow path that is disposed within a laundry appliance 12 for delivering residually formed or passively formed secondary condensate 14 through portions of the laundry appliance 12, and into a sump 16 for the laundry appliance 12. When this secondary condensate 14 is moved to the sump 16, a pump 18 is adapted to move this secondary condensate 14, along with a primary condensate 20, to a different location of the appliance 12 or to an outlet of the appliance 12.

According to various aspects of the device, the laundry appliance 12, typically a condensing dryer, includes a blower 22 for delivering process air 24 through an airflow path 26 that includes a rotating drum 28. A condensation system 30 includes a heat exchanger 32 that dehumidifies process air 24 within a condensing portion 34 of the airflow path 26. Operation of this heat exchanger 32 produces the primary condensate 20 from the process air 24. A primary flow path 36 is included that delivers the primary condensate 20 from the condensing portion 34 of the appliance 12 to a sump 16. Additionally, a residual condensing area 38 is included within the airflow path 26 and is positioned upstream of the heat exchanger 32. The residual condensing area 38 produces the secondary condensate 14. The secondary flow path 10 delivers the secondary condensate 14 from the residual condensing area 38 to the sump 16. As discussed above, the primary condensate 20 and the secondary condensate 14 that are delivered to the sump 16 are pumped away from the sump 16 by a fluid pump 18.

Referring again to FIGS. 1-18, the residual condensing area 38 is typically positioned proximate a lint screen 50 that separates particulate material from the process air 24. During operation of the appliance 12, heated process air 52 exits the rotating drum 28 and moves toward the heat exchanger 32 within the condensation system 30. Before reaching the heat exchanger 32, the process air 24 at least partially cools to a lower temperature process air 54 within an area near the lint screen 50. This lint screen 50 is typically positioned within a lint screen receptacle or lint screen housing 56. As the process air 24 cools, residual or secondary condensate 14 forms and accumulates within a supplemental accumulation area 58 defined within or near the lint screen housing 56. The remainder of the process air 24 that has the residual or secondary condensate 14 removed continues through the lint screen 50 and onto the heat exchanger 32 for the condensation system 30.

Referring again to FIGS. 2-18, the secondary flow path 10 includes a drain member 70 that extends from the residual condensing area 38 to the sump 16. In certain aspects of the device, the secondary flow path 10 can deliver the secondary condensate 14 into a portion of the primary flow path 36 that is positioned downstream of the condensing portion 34 and downstream of the heat exchanger 32. It is also contemplated that the secondary flow path 10 can deliver the secondary condensate 14 to the sump 16, such that the secondary condensate 14 combines with the primary condensate 20 within the sump 16 for removal by the fluid pump 18.

Referring again to FIGS. 2-18, the drain member 70 typically includes an inlet end 80 that engages a basement 82 of the appliance 12 near a lint screen 50 or lint screen housing 56. The drain member 70 also includes an outlet end 84 that engages the basement 82 at a fluid delivery channel 86 that is in communication with the sump 16. The fluid delivery channel 86 is adapted to receive the secondary condensate 14 from the drain member 70 and also deliver the secondary condensate 14 into the sump 16 or into a downstream portion of the primary flow path 36 to be combined with the primary condensate 20. The drain member 70 is positioned within a secondary flow housing 88 that extends from a front portion 90 of the appliance 12 near the lint filter housing into a rear portion 92 of the appliance 12 typically near the sump 16. The secondary flow housing 88 is typically integrally formed within the basement 82 and includes an inlet receptacle 94 and an outlet receptacle 96 that receive the inlet end 80 and outlet end 84, respectively, of the drain member 70. To retain the drain member 70 within the secondary flow housing 88 of the basement 82, the inlet end 80 and outlet end 84 of the drain member 70 are biased against interior walls 98 of the basement 82. Additionally, the drain member 70 includes a snap-type engagement with the basement 82 to retain the drain member 70 within the secondary flow housing 88 of the basement 82.

According to various aspects of the device, the snap-type engagement of the drain member 70 with the secondary flow housing 88 is configured to retain the drain member 70 in a substantially fixed position within the basement 82. The biasing engagement between the inlet and outlet ends 80, 84 and the inlet and outlet receptacles 94, 96 serves to form a sealed engagement 110 between the drain member 70 and the secondary flow housing 88. Each of these engagements (i.e., the snap-type engagement and the biased engagement) serve to retain the drain member 70 within the basement 82 and also serve to limit leaks that may occur as the secondary condensate 14 moves through the secondary flow path 10 from the residual condensing area 38 to the fluid delivery channel 86.

Referring now to FIGS. 10-18, the sealed engagement 110 between the inlet and outlet ends 80, 84 of the drain member 70 and the inlet and outlet receptacles 94, 96 of the secondary flow housing 88 are supplemented through the inclusion of annular structures 120 that are defined within the inlet and outlet receptacles 94, 96. These annular structures 120 serve to matingly engage the inlet and outlet ends 80, 84, respectively, of the drain member 70. Positioned at the end of each annular structure 120 can be included a gasket 122 or seal that receives the inlet and outlet ends 80, 84, respectively, of the drain member 70. In order to engage the annular structures 120 of the inlet and outlet receptacles 94, 96, each of the inlet and outlet ends 80, 84 includes a corresponding annular recess 124. When the inlet and outlet ends 80, 84 are engaged with the corresponding inlet and outlet receptacles 94, 96, the gasket 122 and the annular structures 120 of the inlet and outlet receptacles 94, 96 matingly engage and fit within the annular recesses 124 of the inlet and outlet ends 80, 84 for the drain member 70.

Referring again to FIGS. 10-18, the inlet receptacle 94 can include guide ribs 130 and at least one through slot 132 that selectively receives abutment structures 134 defined within the inlet end 80 of the drain member 70. During installation of the drain member 70 within the secondary flow housing 88, it is typical that the inlet end 80 is first inserted within the inlet receptacle 94. In this manner, the abutment structures 134 of the inlet end 80 are guided by the guide ribs 130 and into the through slot 132 that are defined within the inlet receptacle 94.

The abutment structures 134 of the inlet end 80 can include abutment tabs 136 that extend at least partially through the through slots 132 that are defined within the inlet receptacle 94. Additionally, the abutment structures 134 can include a bumper 138 that slidably engages the guide ribs 130 as the inlet end 80 is moved toward and into the inlet receptacle 94. It is contemplated that the bumper 138 and the abutment tabs 136 can be one and the same structure. It is also contemplated that the bumper 138 can be a separate member from the abutment tabs 136. In such an embodiment, the abutment tabs 136 are configured to extend through the through slots 132 defined within the inlet receptacle 94. The bumper 138, in this embodiment, is typically configured to engage and bias against an interior wall 98 of the basement 82 defined within the inlet receptacle 94.

Through the engagement of the abutment structures 134 of the inlet end 80 for the drain member 70 and the inlet receptacle 94 for the basement 82, the drain member 70 can be biased against the inlet receptacle 94. Subsequently, the drain member 70 can be rotationally operated 126 in a generally upward direction so that the outlet end 84 can be rotated into engagement with the outlet receptacle 96. Through this rotation, the inlet end 80, being engaged with the inlet receptacle 94, acts as a pivot or fulcrum 128 for rotating the outlet end 84 toward an installed position 140 within the secondary flow housing 88.

Referring again to FIGS. 10-18, the outlet end 84 of the drain member 70 includes an angled surface 142 that may have a profile that is oblique to the slanted surface 144 of the outlet receptacle 96. Through this oblique configuration of the outlet end 84 of the drain member 70, a leading edge 146 of the outlet end 84 is configured to bypass the annular structure 120 of the outlet receptacle 96. The obliquely oriented leading edge 146 of the outlet end 84 also serves to partially bias or outwardly deflect 162 portions of the basement 82 at the outlet receptacle 96. Through this deflection of the basement 82, the outlet receptacle 96 can be manipulated to allow for installation of the outlet end 84 of the drain member 70 into the installed position 140. Portions of the retaining flange 148 surrounding the annular recess 124 may not include the angled surface 142. The areas of the retaining flange 148 typically engage the inward-facing surface 152 in a generally flush configuration. These portions of the retaining flange 148 can partially receive and oppose the biasing forces 172 exerted upon the drain member 70.

After the leading edge 146 passes over the annular structure 120 of the outlet end 84, the annular structure 120 is configured to snapingly engage the annular recess 124 defined within the outlet end 84. When the annular recess 124 receives the annular structure 120, the outlet receptacle 96 is matingly engaged with the outlet end 84 of the drain member 70 to define the installed position 140. Additionally, the outlet end 84 can include a retaining flange 148 that selectively engages at least one retaining rib 150 defined within the outlet receptacle 96. The retaining rib 150 is typically offset from the inward-facing surface 152 of the outlet receptacle 96. Through this configuration, a retaining slot 154 is defined within the outlet receptacle 96 to receive the retaining flange 148 of the outlet end 84. Through the engagement of the retaining flange 148 with the one or more retaining ribs 150, the outlet end 84 is laterally aligned with the outlet receptacle 96. Additionally, the retaining flange 148 of the outlet end 84 can include an extending portion 158 that abuts an underside 160 of the fluid delivery channel 86 defined within the basement 82. Through the use of the extending portion 158, the at least one retaining rib 150 of the outlet receptacle 96 and the retaining flange 148 of the outlet end 84, the outlet end 84 can be accurately inserted within the outlet receptacle 96 to define the installed position 140. The use of these structures also serves to accurately position the annular structure 120 within the annular recess 124 to limit leaks during operation of the appliance 12. To increase the structural rigidity of the drain member 70, various reinforcing ribs 164 can be positioned along a length of the drain member 70. These reinforcing ribs 164 can be more robust near the inlet and outlet ends 80, 84 to resist buckling that may tend to occur as a result of the outward deflection 162 and biasing forces 172 that are generated during installation and use of the appliance 12.

Referring again to FIGS. 10-18, the annular structure 120 of the inlet receptacle 94 can include an elongated configuration. Accordingly, the annular structure 120 at the inlet receptacle 94 can define a generally elliptical or oblong annular structure 120. Similarly, the annular recess 124 at the inlet end 80 of the drain member 70 can also include a corresponding oblong configuration 170 that receives the generally oblong annular structure 120 of the inlet receptacle 94. Through this oblong configuration 170 that forms an elongated surface of the annular structure 120, and the annular recess 124, the annular structure 120 slidably engages the annular recess 124 to define a number of positions that can sealingly engage the annular structure 120 within the annular recess 124. Accordingly, a certain amount of play or tolerance is designed into the engagement between the inlet end 80 and inlet receptacle 94. These tolerances can be utilized during installation of the drain member 70 where the outlet end 84 of the drain member 70, as it passes over the annular structure 120 of the outlet receptacle 96, may generate an increased biasing force 172 against the inlet receptacle 94. This inlet receptacle 94 is able to receive this additional biasing force 172 by allowing for minimal controlled movement 174 between the annular structure 120 and the annular recess 124. This minimal controlled movement 174 and tolerance between the annular structure 120 and annular recess 124 of the inlet end 80 and inlet receptacle 94 can also serve to accommodate various tolerances that may exist during manufacture of various laundry appliances 12.

Accordingly, across a laundry appliance platform, the overall length of the secondary flow housing 88 may slightly vary between different manufactured models. Additionally, slight tolerances or variations may occur within different drain members 70. These tolerances or manufacturing differences can be accommodated through the elongated configuration and sliding engagement of the annular structure 120 of the inlet receptacle 94 with the annular recess 124 of the inlet end 80.

Referring again to FIGS. 11-18, the inlet end 80 of the drain member 70 can include an angled portion 180 of a drain tube within the drain member 70. This angled portion 180 serves to engage a bottom 182 of the residual condensing area 38 of the basement 82. In this manner, the inlet end 80 of the drain member 70 engages a drain aperture 184 of the inlet receptacle 94 in a generally vertical orientation. Accordingly, the secondary condensate 14 that is formed or generated within the residual condensing area 38 can flow according to the force of gravity from the residual condensing area 38 and into the drain member 70 via the drain aperture 184.

Referring again to FIGS. 1-18, the fluid delivery system for the laundry appliance 12 can include the condensation system 30 that is disposed within the basement structure for the appliance 12. As discussed above, the condensation system 30 includes a dehumidifier or other heat exchanger 32 for separating condensate or other process air 24 that is moved through the appliance 12. The primary flow path 36 delivers the primary condensate 20 from the condensation system 30 and to the sump 16. The residual condensing area 38 is positioned distal from the condensation system 30. The residual condensing area 38 produces secondary condensate 14 that is separately delivered to the sump 16. The drain member 70 extends from the residual condensing area 38 to the fluid delivery channel 86 for delivering the secondary condensate 14 to the sump 16. As discussed above, the drain member 70 includes the inlet end 80 that is biased against a wall of the basement 82 proximate the residual condensing area 38. The drain member 70 also includes an outlet end 84 that is biased against the fluid delivery channel 86.

Referring again to FIGS. 1-18, the residual condensing area 38 can include a portion of the airflow path 26 for the appliance 12 that is positioned between the rotating drum 28 and the heat exchanger 32. This residual condensing area 38 produces the secondary condensate 14 that is separately delivered to the sump 16. This residual condensing area 38 typically operates through a residual cooling of the process air 24 as it moves from the rotating drum 28 and toward the heat exchanger 32. This residual cooling of the process air 24 results in the formation of the residual or secondary condensate 14 that accumulates within the supplemental accumulation area 58 of the lint filter housing. In order to prevent this accumulated secondary condensate 14 from saturating accumulated lint within the lint filter, the drain member 70 that forms the secondary flow path 10 serves to remove the secondary condensate 14 toward the sump 16.

Referring again to FIGS. 10, 12 and 15, the oblique configuration of the angled surface 142 for the outlet end 84 for the drain member 70 can engage the outlet receptacle 96 which also includes the slanted surface 144. The angled surface 142 of the outlet end 84 is typically oblique from and includes an angle that is different from the inward-facing slanted surface 144 of the outlet receptacle 96. These different angled and slanted surfaces 142, 144, during installation of the outlet end 84, can serve to bias the inward-facing surface 152 of the outlet end 84 in a generally outward direction 190. This deflection in the outward direction 190 serves to allow a clearance space to install the outlet end 84 of the drain member 70 within the outlet receptacle 96. Once in the installed position 140, the outlet end 84 can deflect back into its original angled position so that the outlet receptacle 96 can seat within the annular recess 124 of the outlet end 84. The angled configuration of the sloped surface for the outlet receptacle 96 is also reflected within the annular structure 120 that extends outward therefrom. Accordingly, the angled surfaces 142 of the outlet end 84 and the slanted surface 144 of the outlet receptacle 96 form a ramping configuration that serves to bias an interior wall 98 of the outlet receptacle 96 away from the outlet end 84 to provide for installation of the outlet end 84 within the outlet receptacle 96. This biasing engagement also forms the snap-type engagement between the outlet end 84 and the outlet receptacle 96. This snap engagement is typically formed between the engagement of the annular structure 120 of the outlet receptacle 96 and the annular recess 124 of the outlet end 84. This engagement serves to retain the drain member 70 in the installed position 140 within the secondary flow housing 88 of the basement 82.

According to various aspects of the device, the secondary flow path 10 described herein can be utilized within varying types of laundry appliances 12. These laundry appliances 12 can include, but are not limited to, condensing dryers, heat pump dryers, vented dryers, ventless dryers, washing machines, combination washers and dryers, and other similar laundry appliances 12. It also contemplated that the secondary flow path 10 described herein can also be used within other non-laundry appliances. Such appliances can include, but are not limited to, dishwashers, refrigerators, coolers, water heaters, combinations thereof, and other similar residential and commercial appliances and fixtures.

In forming the drain member 70, various molding processes can be utilized. Typically, an injection molding or blow molding process can be used. Because of the length of the drain member 70, a gas-assist process can be utilized to deposit the molding material throughout the length of the mold for forming the drain member 70.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A laundry appliance comprising:

a blower for delivering process air through an airflow path that includes a rotating drum;

a condensation system having a heat exchanger that dehumidifies process air within a condensing portion of the airflow path to produce a primary condensate;

a residual condensing area of the airflow path and positioned upstream of the heat exchanger, wherein the residual condensing area produces secondary condensate;

a primary flow path that delivers the primary condensate from the condensing portion to a sump; and a secondary flow path that is defined by a drain member that delivers the secondary condensate from the residual condensing area to the sump, wherein the drain member includes an inlet end that engages a basement structure proximate a lint filter housing and an outlet end that engages the basement structure at a fluid delivery channel, and wherein the inlet end and the outlet end are each biased against interior wall of the basement structure.

2. The laundry appliance of claim 1, wherein the residual condensing area is positioned proximate a lint screen that separates particulate material from the process air.

3. The laundry appliance of claim 1, wherein the secondary flow path delivers the secondary condensate to the primary flow path at a position downstream of the condensing portion.

4. The laundry appliance of claim 1, wherein the basement structure includes an inlet receptacle and an outlet receptacle that receive the inlet end and the outlet end, respectively, of the drain member.

5. The laundry appliance of claim 4, wherein each of the inlet and outlet receptacles includes an annular structure that matingly engages the inlet and outlet ends, respectively.

6. The laundry appliance of claim 5, wherein the annular structure of the inlet receptacle includes an elongated surface that slidably engages an annular recess of the inlet end.

7. The laundry appliance of claim 5, wherein the inlet receptacle includes guide ribs and a through slot that selectively receive abutment structures of the inlet end.

8. The laundry appliance of claim 7, wherein the outlet receptacle includes at least one retaining rib that receives a retaining flange of the outlet end.

9. The laundry appliance of claim 1, wherein the inlet end includes an angled portion of the drain member that engages an underside of the residual condensing area.

10. A laundry appliance comprising:

a blower for delivering process air through an airflow path that includes a rotating drum;

a condensation system having a dehumidifier for separating primary condensate from the process air at a condensing portion of the airflow path;

a primary flow path that delivers the primary condensate from the condensing portion to a sump;

a residual condensing area of the airflow path positioned between the rotating drum and a heat exchanger, wherein the residual condensing area produces secondary condensate that is separately delivered to the sump; and a drain member that extends from the residual condensing area to the sump for delivering the secondary condensate to the sump, wherein the drain member includes an inlet end that engages a basement structure proximate the residual condensing area and an outlet end that engages the basement structure at a fluid delivery channel in communication with the sump, wherein the basement structure includes an inlet receptacle and an outlet receptacle that receive the inlet end and the outlet end, respectively, of the drain member, wherein the inlet end and the outlet end are biased against the basement structure.

11. The laundry appliance of claim 10, wherein each of the inlet and outlet receptacles includes an annular structure that matingly engages the inlet and outlet ends, respectively.

12. The laundry appliance of claim 11, wherein the annular structure of the inlet receptacle includes an elongated surface that slidably engages an annular recess of the inlet end.

13. The laundry appliance of claim 10, wherein the inlet receptacle includes guide ribs and a through slot that selectively receive abutment structures of the inlet end, and wherein the outlet receptacle includes at least one retaining rib that receives a retaining flange of the outlet end.

14. A fluid delivery system for a laundry appliance, the fluid delivery system comprising:

a condensation system disposed within a basement structure and having a dehumidifier for separating primary condensate from process air;

a primary flow path that delivers the primary condensate from the condensation system to a sump;

a residual condensing area positioned distal from the condensation system, wherein the residual condensing area produces secondary condensate that is separately delivered to the sump; and a drain member that extends from the residual condensing area to a fluid delivery channel for delivering the secondary condensate to the sump, wherein the drain member includes an inlet end that is biased against a wall of the basement structure proximate the residual condensing area and an outlet end that is biased against the fluid delivery channel, wherein the basement structure includes an inlet receptacle and an outlet receptacle that receive the inlet end and the outlet end, respectively, of the drain member, wherein the inlet end and the outlet end are biased against the basement structure.

15. The fluid delivery system of claim 14, wherein each of the inlet and outlet receptacles include an annular structure that matingly engages the inlet and outlet ends, respectively, and wherein the annular structure of the inlet receptacle includes an elongated surface that slidably engages an annular recess of the inlet end.

* * * * *